US008731204B2

(12) United States Patent
Sperschneider et al.

(10) Patent No.: US 8,731,204 B2
(45) Date of Patent: May 20, 2014

(54) DEVICE AND METHOD FOR GENERATING A MULTI-CHANNEL SIGNAL OR A PARAMETER DATA SET

(75) Inventors: Ralph Sperschneider, Erlangen (DE); Juergen Herre, Buckenhof (DE); Johannes Hilpert, Nuremberg (DE); Christian Ertel, Igensdorf (DE); Stefan Geyersberger, Wuerzburg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 1101 days.

(21) Appl. No.: 11/683,741

(22) Filed: Mar. 8, 2007

(65) Prior Publication Data

US 2007/0206690 A1 Sep. 6, 2007

Related U.S. Application Data

(63) Continuation of application No. PCT/EP2005/008694, filed on Aug. 10, 2005.

(30) Foreign Application Priority Data

Sep. 8, 2004 (DE) ..... 10 2004 043 521

(51) Int. Cl.
*H04R 5/00* (2006.01)

(52) U.S. Cl.
USPC ..... 381/22; 381/23; 704/500; 704/501

(58) Field of Classification Search
USPC ..... 381/1, 17–18, 22–23; 704/500–501
See application file for complete search history.

(56) References Cited

U.S. PATENT DOCUMENTS 5,524,054 A 6/1996 Spille
5,534,054 A 7/1996 Woodard et al.
5,706,309 A 1/1998 Eberlein et al.

(Continued)

FOREIGN PATENT DOCUMENTS

EP 0631458 6/1994
EP 0957639 A2 11/1999

(Continued)

OTHER PUBLICATIONS

AES preprint 3799 entitled: "Intensity stereo coding" J. Herre, K. H. Brandenburg, D. Lederer, Feb. 1994, Amsterdam.

(Continued)

*Primary Examiner* — Disler Paul
(74) *Attorney, Agent, or Firm* — Michael A. Glenn; Perkins Coie LLP

(57) ABSTRACT

For flexibly signaling a synchronous mode or an asynchronous mode in the multi-channel parameter reconstruction, a parameter configuration cue is inserted in the data stream, which is used by a configurator on the side of a multi-channel decoder to configure a multi-channel reconstructor. If the parameter configuration cue has a first meaning, the configurator will look for further configuration information in its input data, while, when the parameter configuration cue has another meaning, the configurator performs a configuration setting of the multi-channel reconstructor based on information on a coding algorithm with which transmission channel data have been coded, so that it is ensured efficiently on the one hand and flexibly on the other hand that there will always be obtained a correct association between parameter data and decoded transmission channel data.

15 Claims, 8 Drawing Sheets

(56) References Cited

U.S. PATENT DOCUMENTS

| | | | | |
|---|---|---|---|---|
| 6,349,284 | B1 | 2/2002 | Park et al. | |
| 6,452,941 | B1 | 9/2002 | Bruhn | |
| 6,529,604 | B1 | 3/2003 | Park et al. | |
| 6,539,357 | B1 | 3/2003 | Sinha | |
| 7,006,636 | B2 | 2/2006 | Baumgarte et al. | |
| 7,751,572 | B2 * | 7/2010 | Villemoes et al. | 381/23 |
| 2003/0026441 | A1 | 2/2003 | Faller | |
| 2003/0035553 | A1 | 2/2003 | Baumgarte et al. | |
| 2003/0219130 | A1 | 11/2003 | Baumgarte et al. | |
| 2005/0226426 | A1 * | 10/2005 | Oomen et al. | 381/23 |
| 2006/0085200 | A1 * | 4/2006 | Allamanche et al. | 704/500 |
| 2008/0052089 | A1 * | 2/2008 | Takagi | 704/503 |
| 2010/0046759 | A1 * | 2/2010 | Pang et al. | 381/22 |

FOREIGN PATENT DOCUMENTS

| | | | |
|---|---|---|---|
| EP | 1414273 | | 4/2004 |
| JP | 2000-228800 | | 8/2000 |
| JP | 2001-209399 | A1 | 8/2001 |
| JP | 2004-078183 | A1 | 3/2004 |
| TW | 533746 | | 5/2003 |
| TW | 569551 | | 1/2004 |
| TW | 2004/03944 | | 3/2004 |
| WO | WO 99/26455 | | 5/1999 |
| WO | 2003090207 | A1 | 10/2003 |
| WO | WO 03/090208 | | 10/2003 |

OTHER PUBLICATIONS

AES convention paper 5574 entitled "Binaural cue coding applied to stereo and multi-channel audio compression", C. Faller, F. Baumgarte, May 2002, München.

"Binaural Cue Coding. Part. II: Schemes and Applications", C. Faller and F. Baumgarte, IEEE: Transactions of Audio and Speech Proc., vol. 11, No. 6, Nov. 1993.

J. Herre, C. Faller, C. Ertel, J. Hilpert, A. Hoelzer, C. Spenger, MP3 Surround: Efficient and Compatible Coding of Multi-Channel Audio, 116th AES Convention, Berlin, 2004, preprint 6049.

"Musicam Surround: A universal multi-channel coding system compatible with ISO/IEC 11172-3", G. Theile and G. Stoll, AES Preprint, Oct. 1992, San Francisco.

"Improved MPEG 2 Audio multi-channel encoding", B. Grill, J. Herre, K. H. Brandenburg, E. Eberlein, J. Koller, J. Miller, AES Preprint 3865, Feb. 1994, Amsterdam.

E. Schuijer, J. Breebaart, H. Purnhagen, J. Engdegård entitled "Low-Complexity Parametric Stereo Coding", 119$^{th}$ AES Convention, Berlin, 2004, Preprint 6073.

ISO/IEC 14496-3: 2001/FDAMm 2 (Parametric Audio).

Faller, Christoph U. Baumgarte, Frank: Binaural Cue Coding—Part II: Schemes and Applications. In: IEEE Transactions on Speech and Audio Processing, vol. 11, No. 6, Nov. 2003, S. 520-531.

Faller C. et al: „Binaural Cue Coding Applied to Stereo and Multi-Channel Audio Compression Preprints of Papers Presented At the AES Convention, XX, XX, Bd. 112, Nr. 5574, 10. Mai 2002 (May 10, 2002), Seiten 1-9, XP009024737 Munich, Germany, Seite 2 rechte Spalte, Absatz 3; Abbildung 10.

Faller C., et al.: "Efficient Representation of Spatial Audio Using Perceptual Parametrization", Applications of Signal Processing to Audio and Acoustics 2001, IEEE Workshop, Oct. 2001, pp. 199-202.

van der Wall, R.G. et al.: "Subband Coding of Stereophonic Digital Audio Signals", Proc. of ICASSP '91, IEEE Computer Society, May 1991, pp. 3601-3604.

Japanese Office Action dated May 25, 2010, for parallel Japanese application No. 2007-530606, 4 pages.

* cited by examiner

| Syntax | No. of bits | Mnemonic |
|---|---|---|
| BccConfig(numTransChan,samplingFrequencyHz,codec) | | |
| { | | |
| if (! useSameBccConfig) { | 1 | bslbf |
| if ( codecToBccConfigAlignment ) { | 1 | bslbf |
| switch (codec) { | | |
| case MP3: bccConfigID = MP3S_V1; break; | | |
| case CoderX: bccConfigID = ConfigX; break; | | |
| case CoderY: bccConfigID = ConfigY; break; | | |
| default: /* reserved */ | | |
| } | | |
| } | | |
| else { | | |
| bccConfigID; | 3 | uimsbf |
| } | | |
| switch (bccConfigID) { | | |
| break; | | |
| case MP3S_V1: | | |
| numGroupedBlocks = 2; | | |
| numBccDataMand=1; | | |
| bccDataID[0]=ICLD_V1; | | |
| blockLen = 576; | | |
| braek; | | |
| case ConfigX: /* to be specified */ | | |
| case ConfigY: /* to be specified */ | | |
| case INDIVIDUAL: | | |
| /* individual configuration settings | | |
| to be transmitted explicitly */ | | |
| default: | | |
| /* reserved */ | | |
| } | | |
| } | | |
| } | | |

FIGURE 4C

DEVICE AND METHOD FOR GENERATING A MULTI-CHANNEL SIGNAL OR A PARAMETER DATA SET

CROSS-REFERENCE TO RELATED APPLICATIONS

This application is a continuation of copending International Application No. PCT/EP2005/008694, filed on Aug. 10, 2005, which designated the United States and was not published in English.

TECHNICAL FIELD

The present invention relates to parametric multi-channel processing techniques and, in particular, to encoders/decoders for generating and/or reading a flexible data syntax and for associating parameter data with the data of the downmix and/or transmission channels.

BACKGROUND

In addition to the two stereo channels, a recommended multi-channel surround representation includes a center channel C and two surround channels, i.e. the left surround channel Ls and the right surround channel Rs, and additionally, if applicable, a subwoofer channel also referred to as LFE channel (LFE=Low Frequency Enhancement). This reference sound format is also referred to as 3/2 (plus LFE) stereo and recently also as 5.1 multi-channel, which means that there are three front channels and two surround channels. In general, five or six transmission channels are required. In a reproduction environment, at least five loudspeakers are required in the respective five different positions to obtain an optimal so-called sweet spot a determined distance from the five correctly placed loudspeakers. However, with respect to its positioning, the subwoofer is usable in a relatively free way.

There are several techniques for reducing the amount of data required to transmit a multi-channel audio signal. Such techniques are also called joint stereo techniques. For this purpose, reference is made to FIG. 5. FIG. 5 shows a joint stereo device 60. This device may be a device implementing, for example, the intensity stereo technique (IS technique) or the binaural cue coding technique (BCC technique). Such a device generally receives at least two channels (CH1, CH2, . . . CHn) as input signal and outputs at least one single carrier channel (downmix) and parametric data, i.e. one or more parameter sets. The parametric data are defined so that an approximation of each original channel (CH1, CH2, . . . CHn) may be calculated in a decoder.

Normally, the carrier channel will include subband samples, spectral coefficients or time domain samples, etc., which provide a comparatively fine representation of the underlying signal, while the parametric data and/or parameter sets do not include any such samples or spectral coefficients. Instead, the parametric data include control parameters for controlling a determined reconstruction algorithm, such as weighting by multiplication, time shifting, frequency shifting, . . . . The parametric data thus include only a comparatively rough representation of the signal or the associated channel. Expressed in numbers, the amount of data required by a carrier channel (which is compressed, i.e. coded by means of AAC, for example) is in the range of 60 to 70 kbit/s, while the amount of data required by parametric side information is in the order from 1.5 kbit/s for a channel. One example for parametric data are the known scaling factors, intensity stereo information or binaural cue parameters, as will be described below.

The intensity stereo coding technique is described in the AES preprint 3799 entitled "Intensity stereo coding" J. Herre, K. H. Brandenburg, D. Lederer, February 1994, Amsterdam. In general, the concept of intensity stereo is based on a main axis transform which is to be applied to data of the two stereophonic audio channels. If most data points are placed around the first main axis, a coding gain may be achieved by rotating both signals by a determined angle prior to the coding. However, this does not always apply to real stereophonic reproduction techniques. The reconstructed signals for the left and right channels consist of differently weighted or scaled versions of the same transmitted signal. Nevertheless, the reconstructed signals differ in amplitude, but they are identical with respect to their phase information. The energy time envelopes of both original audio channels, however, are maintained by means of the selective scaling operation typically operating in frequency-selective fashion. This corresponds to the human sound perception at high frequencies where the dominant spatial cues are determined by the energy envelopes.

In addition, in practical implementations the transmitted signal, i.e. the carrier channel, is formed of the sum signal of the left channel and the right channel instead of rotating both components. Furthermore, this processing, i.e. the generation of the intensity stereo parameters for performing the scaling operation, is performed in a frequency-selective way, i.e. independently of each other for each scale factor band, i.e. for each encoder frequency partition. Preferably, both channels are combined to form a combined or "carrier" channel. In addition to the combined channel, the intensity stereo information is determined which depends on the energy of the first channel, the energy of the second channel and the energy of the combined or sum channel.

The BCC technique is described in the AES convention paper 5574 entitled "Binaural cue coding applied to stereo and multi-channel audio compression", C. Faller, F. Baumgarte, May 2002, München. In BCC coding, a number of audio input channels is converted to a spectral representation using a DFT-based transform with overlapping windows. The resulting spectrum is divided into non-overlapping partitions. Each partition has a bandwidth proportional to an equivalent right-angled bandwidth (ERB). So-called inter-channel level differences (ICLD) as well as so-called inter-channel time differences (ICTD) are calculated for each partition, i.e. for each band and for each frame k, i.e. a block of time samples. The ICLD and ICDT parameters are quantized and coded to obtain a BCC bit stream. The inter-channel level differences and the inter-channel time differences are given for each channel with respect to a reference channel. In particular, the parameters are calculated according to predetermined formulae depending on the particular divisions of the signal to be processed.

On the decoder side, the decoder receives a mono signal and the BCC bit stream, i.e. a first parameter set for the inter-channel time differences and a second parameter set for the inter-channel level differences per frame. The mono signal is transformed to the frequency domain and input into a synthesis block also receiving decoded ICLD and ICTD values. In the synthesis block or reconstruction block, the BCC parameters (ICLD and ICTD) are used to perform a weighting operation of the mono signal to reconstruct the multi-channel signal, which then, after a frequency/time conversion, represents a reconstruction of the original multi-channel audio signal.

In the case of BCC, the joint stereo module 60 operates to output the channel side information so that the parametric channel data are quantized and coded ICLD and ICTD parameters, wherein one of the original channels may be used as reference channel for coding the channel side information. Normally, the carrier channel is formed of the sum of the participating original channels.

Of course, the above technique only provides a mono representation for a decoder which is only able to decode the carrier channel, but which is not capable of generating the parameter data for generating one or more approximations of more than one input channel.

The audio coding technique referred to as BCC technique is further described in the US patent applications US 2003/0219130 A1, 2003/0026441 A1 and 2003/0035553 A1. In addition, further see "Binaural Cue Coding. Part. II: Schemes and Applications", C. Faller and F. Baumgarte, IEEE: Transactions on Audio and Speech Proc., Vol. 11, No. 6, November 1993. Further, also see C. Faller and F. Baumgarte "Binaural Cue Coding applied to Stereo and Multi-Channel Audio compression", Preprint, 112$^{th}$ Convention of the Audio Engineering Society (AES), May 2002, and J. Herre, C. Faller, C. Ertel, J. Hilpert, A. Hoelzer, C. Spenger "MP3 Surround: Efficient and Compatible Coding of Multi-Channel Audio", 116$^{th}$ AES Convention, Berlin, 2004, Preprint 6049. In the following, there will be represented a typical general BCC scheme for multi-channel audio coding in more detail with respect to FIGS. 6 to 8. FIG. 6 shows a general BCC coding scheme for coding/transmission of multi-channel audio signals. The multi-channel audio input signal is input at an input 110 of a BCC encoder 112 and is "mixed down" in a so-called downmix block 114, i.e. converted to a single sum channel. In the present example, the signal at the input 110 is a 5-channel surround signal having a front left channel and a front right channel, a left surround channel and a right surround channel, and a center channel. Typically, the downmix block generates a sum signal by simple addition of these five channels into a mono signal. Other downmix schemes are known in the art, all resulting in generating, using a multi-channel input signal, a downmix signal having a single channel or having a number of downmix channels which, in any case, is less than the number of original input channels. In the present example, a downmix operation would already be achieved if four carrier channels were generated from the five input channels. The single output channel and/or the number of output channels is output on a sum signal line 115.

Side information obtained by a BCC analysis block 116 are output on a side information line 117. In the BCC analysis block, inter-channel level differences (ICLD), inter-channel time differences (ICTD) or inter-channel correlation values (ICC values) may be calculated. Thus, there are three different parameter sets, namely the inter-channel level differences (ICLD), the inter-channel time differences (ICTD) and the inter-channel correlation values (ICC), for the reconstruction in the BCC synthesis block 122.

The sum signal and the side information with the parameter sets are typically transmitted to a BCC decoder 120 in a quantized and coded format. The BCC decoder splits the transmitted (and decoded, in the case of a coded transmission) sum signal into a number of subbands and performs scalings, delays and further processing to generate the subbands of the several channels to be reconstructed. This processing is performed so that the ICLD, ICTD and ICC parameters (cues) of a reconstructed multi-channel signal at output 121 are similar to the respective cues for the original multi-channel signal at input 110 into the BCC encoder 112. For this purpose, the BCC decoder 120 includes a BCC synthesis block 122 and a side information processing block 123.

The following will illustrate the internal structure of the BCC synthesis block 122 with respect to FIG. 7. The sum signal on the line 115 is input into a time/frequency conversion block typically embodied as filter bank FB 125. At the output of block 125, there is a number N of subband signals or, in an extreme case, a block of spectral coefficients, if the audio filter bank 125 performs a transform generating N spectral coefficients from N time domain samples.

The BCC synthesis block 122 further includes a delay stage 126, a level modification stage 127, a correlation processing stage 128 and a stage IFB 129 representing an inverse filter bank. At the output of the stage 129, the reconstructed multi-channel audio signal having, for example, five channels in the case of a 5-channel surround system may be output on a set of loudspeakers 124, as illustrated in FIG. 6.

FIG. 7 further illustrates that the input signal s(n) is converted to the frequency domain or filter bank domain by means of element 125. The signal output by element 125 is multiplied so that several versions of the same signal are obtained, as indicated by node 130. The number of versions of the original signal is equal to the number of output channels in the output signal to be reconstructed. If each version of the original signal is subjected to a determined delay $d_1, d_2, \ldots d_i, d_N$ at the node 130, the result is the situation at the output of blocks 126, which includes the versions of the same signal, but with different delays. The delay parameters are calculated by the side information processing block 123 in FIG. 6 and derived from the inter-channel time differences as they were determined by the BCC analysis block 116.

The same applies to the multiplication parameters $a_1, a_2 \ldots a_i, a_N$, which are also calculated by the side information processing block 123 based on the inter-channel level differences determined by the BCC analysis block 116.

The ICC parameters are calculated by the BCC analysis block 116 and used for controlling the functionality of the block 128 so that determined correlation values between the delayed and level-manipulated signals are obtained at the output of block 128. It is to be noted that the order of the stages 126, 127, 128 may be different from that represented in FIG. 7.

It is further to be noted that, in a blockwise processing of the audio signal, the BCC analysis is also performed blockwise. Furthermore, the BCC analysis is also performed frequency-wise, i.e. in a frequency-selective way. This means that, for each spectral band, there is an ICLD parameter, an ICTD parameter and an ICC parameter for each block. The ICTD parameters for at least one block for at least one channel across all bands thus represent the ICTD parameter set. The same applies to the ICLD parameter set representing all ICLD parameters for at least one block for all frequency bands for the reconstruction of at least one output channel. The same applies, in turn, to the ICC parameter set which again includes several individual ICC parameters for at least one block for various bands for the reconstruction of at least one output channel on the basis of the input channel or sum channel.

In the following, reference is made to FIG. 8 showing a situation from which the determination of BCC parameters may be seen. Normally, the ICLD, ICTD and ICC parameters may be defined between any channel pairs. Typically a determination of the ICLD and the ICTD parameters is performed between a reference channel and each other input channel, so that there is a distinct parameter set for each of the input channels except the reference channel. This is also illustrated in FIG. 8A.

However, the ICC parameters may be defined differently. In general, ICC parameters may be generated in the encoder between any channel pairs, as also illustrated schematically in FIG. 8B. In this case, a decoder would perform an ICC synthesis so that approximately the same result is obtained as it was present in the original signal between any channel pairs. However, there has been the suggestion to calculate only ICC parameters between the two strongest channels at any time, i.e. for each time frame. This scheme is represented in FIG. 8C, which shows an example in which, at one time, an ICC parameter between the channels 1 and 2 is calculated and transmitted, and in which, at another time, an ICC parameter between the channels 1 and 5 is calculated. The decoder then synthesizes the inter-channel correlation between the two strongest channels in the decoder and executes further typically heuristic rules for synthesizing the inter-channel coherence for the remaining channel pairs.

With respect to the calculation of, for example, the multiplication parameters $a_1, \ldots a_N$ based on the transmitted ICLD parameters, reference is made to the cited AES convention paper 5574. The ICLD parameters represent an energy distribution in an original multi-channel signal. Without loss of generality, FIG. 8A shows that there are four ICLD parameters representing the energy difference between all other channels and the front left channel. In the side information processing block 123, the multiplication parameters $a_1, \ldots a_N$ are derived from the ICLD parameters so that the total energy of all reconstructed output channels is the same energy as present for the transmitted sum signal or is at least proportional to this energy. One way to determine these parameters is a two-stage process in which, in a first stage, the multiplication factor for the left front channel is set to 1, while multiplication factors for the other channels in FIG. 8C are set to the transmitted ICLD values. Then, in a second stage, the energy of all five channels is calculated and compared to the energy of the transmitted sum signal. Then, all channels are downscaled, namely using a scaling factor which is equal for all channels, wherein the scaling factor is selected so that the total energy of all reconstructed output channels after the scaling is equal to the total energy of the transmitted sum signal and/or the transmitted sum signals.

With respect to the inter-channel coherence measure ICC transmitted from the BCC encoder to the BCC decoder as further parameter set, it is to be noted that a coherence manipulation could be performed by modification of the multiplication factors, such as by multiplying the weighting factors of all subbands by random numbers having values between 20 log $10^{-6}$ and 20 log $10^{6}$. The pseudo random sequence is typically selected so that the variance for all critical bands is approximately equal and that the average value within each critical band is zero. The same sequence is used for the spectral coefficients of each different frame or block. Thus, the width of the audio scene is controlled by modifications of the variances of the pseudo random sequence. A larger variance generates a larger hearing width. The variance modification may be performed in individual bands having a width of a critical band. This allows the simultaneous existence of several objects in a hearing scene, wherein each object has a different hearing width. A suitable amplitude distribution for the pseudo random sequence is a uniform distribution on a logarithmic scale, such as represented in the US patent publication 2002/0219130 A1.

In order to transmit the five channels in a compatible way, for example in a bit stream format which is also suitable for a normal stereo decoder, there may be used the so-called matrixing technique described in "MUSICAM Surround: A universal multi-channel coding system compatible with ISO/IEC 11172-3", G. Theile and G. Stoll, AES Preprint, October 1992, San Francisco.

Furthermore, see further multi-channel coding techniques described in the publication "Improved MPEG 2 Audio multi-channel encoding", B. Grill, J. Herre, K. H. Brandenburg, E. Eberlein, J. Koller, J. Miller, AES Preprint 3865, February 1994, Amsterdam, wherein a compatibility matrix is used to obtain the downmix channels from the original input channels.

In summary, you can say that the BCC technique allows an efficient and also backward-compatible coding of multi-channel audio material, as also described, for example, in the specialist publication by E. Schuijer, J. Breebaart, H. Purnhagen, J. Engdegård entitled "Low-Complexity Parametric Stereo Coding", 119$^{th}$ AES Convention, Berlin, 2004, Preprint 6073. In this context, mention should also be made of the MPEG-4 standard and particularly the expansion to parametric audio techniques, wherein this standard part is also known by the designation ISO/IEC 14496-3: 2001/FDAM 2 (Parametric Audio). In this respect, there should be mentioned, in particular, the syntax in table 8.9 of the MPEG-4 standard entitled "syntax of the ps_data( )". In this example, we should mention the syntax elements "enable_icc" and "enable_ipdopd", wherein these syntax elements are used to turn on and off a transmission of an ICC parameter and a phase corresponding to inter-channel time differences. There should further be mentioned the syntax elements "icc_data( )" "ipd_data( )" and "opd_data( )".

In summary, it is to be noted that generally such parametric multi-channel techniques are used employing one or several transmitted carrier channels, wherein M transmitted channels are formed from N original channels to reconstruct again the N output channels or a number K of output channels, wherein K is equal to or less than the number of original channels N.

As can be seen from FIG. 6, the BCC analysis is a typical separate preprocessing to generate parameter data on the one hand and one or more transmission channels (downmix channels) on the other hand from a multi-channel signal having N original channels. Typically, these downmix channels are then compressed for example by means of a typical MP3 or AAC stereo/mono encoder, although this is not shown in FIG. 6, so that, on the output side, there is a bit stream representing the transmission channel data in compressed form and that there is further another bit stream representing the parameter data. The BCC analysis thus occurs separately from the actual audio coding of the downmix channels and/or the sum signal 115 of FIG. 6.

The decoder side is similar. A decoder having multi-channel ability will first decode the bit stream including the compressed downmix signal depending on the used coding algorithm and again provide one or more transmission channels on the output side, i.e. typically as a time sequence of PCM data (PCM=Pulse Code Modulation). Then, the BCC synthesis will take place as a distinct separate and isolated postprocessing which signals self-sufficiently with the parameter data stream and is provided with data to generate, on the output side, several output channels preferably equal to the number of the original input channels from the audio-decoded downmix signal.

Thus, it is an advantage of the BCC analysis that it has a distinct filter bank for the purposes of the BCC analysis and a distinct filter bank for the purposes of the BCC synthesis, for example, so that it is separate from the filter bank of the audio encoder/decoder in order not to have to make any compromises regarding audio compression on the one hand and multi-channel reconstruction on the other hand. Generally speaking, the audio compression is thus done separately from the multi-channel parameter processing to be optimally equipped for both fields of application.

However, this concept has the disadvantage that a complete signaling has to be transmitted both for the multi-channel reconstruction and for the audio decoding. This is particularly disadvantageous when, as will typically be the case, both the audio decoder and the multi-channel reconstruction means perform the same or similar steps and thus require the same and/or mutually dependent configuration settings. Due to the completely separate concept, signaling data are thus transmitted twice resulting in an artificial "expansion" of the data amount, which is ultimately due to the fact that one has chosen the separate concept between audio coding/decoding and multi-channel analysis/synthesis.

On the other hand, a complete "linking" of the multi-channel reconstruction to the audio decoding would considerably restrict the flexibility, because in that case the actually important goal of the separation of both processing steps to be able to perform each processing step in an optimal way would have to be given up. Thus, considerable quality losses would arise, in particular in the case of several successive coding/decoding stages also referred to as "tandem" coding. If there is a complete linking of the BCC data to the coded audio data, a multi-channel reconstruction has to be performed with each decoding to perform a multi-channel synthesis again when recoding. Since it is the nature of every parametric technique that it is lossy, losses will accumulate by repeated analysis synthesis analysis so that, with each encoder/decoder stage, the perceptible quality of the audio signal further decreases.

In this case, decoding/encoding of audio data without simultaneous analysis/synthesis processing of the parameter data would only be possible if each audio codec in the tandem chain worked identically, i.e. had the same sampling rate, block length, advance length, windowing, transform, . . . , i.e. had generally the same configuration, and if, in addition, the respective block boundaries also were maintained. Such a concept, however, would considerably restrict the flexibility of the whole concept. Particularly regarding the fact that the parametric multi-channel techniques are intended to supplement already existing stereo data, for example, by additional parameter data, this limitation is all the more painful. Since the already existing stereo data may originate from many different encoders that all use different block lengths or that do not even operate in the frequency domain, but in the time domain etc., such a limitation would take the concept of the later supplementation ad absurdum from the beginning.

SUMMARY

According to an embodiment, a device for generating a multi-channel signal using input data which include transmission channel data representing M transmission channels and parameter data to obtain K output channels, wherein the M transmission channels and the parameter data together represent N original channels, wherein M is less than N and equal to or larger than 1, and wherein K is larger than M, wherein the input data has a parameter configuration cue, may have: multi-channel reconstruction means designed to generate the K output channels from the transmission channel data and the parameter data; and configuration means for configuring the multi-channel reconstruction means, wherein the configuration means is designed to read the input data to interpret the parameter configuration cue, when the parameter configuration cue has a first meaning, extract configuration information contained in the input data and effect a configuration setting of the multi-channel reconstruction means, and when the parameter configuration cue has a second meaning differing from the first meaning, configure the multi-channel reconstruction means using information on a coding algorithm with which the transmission channel data have been decoded from a coded version thereof so that the configuration setting of the multi-channel reconstruction means is identical to a configuration setting of the coding algorithm or depends on a configuration setting of the coding algorithm.

According to another embodiment, a method for generating a multi-channel signal using input data which include transmission channel data representing M transmission channels and parameter data to obtain K output channels, wherein the M transmission channels and the parameter data together represent N original channels, wherein M is less than N and equal to or larger than 1, and wherein K is larger than M, wherein the input data has a parameter configuration cue, may have the steps of: reconstructing the K output channels from the transmission channel data and the parameter data according to a reconstruction algorithm; configuring the reconstruction algorithm by the following sub-steps: reading the input data to interpret the parameter configuration cue; when the parameter configuration cue has a first meaning, extracting configuration information contained in the input data and effecting a configuration setting of the reconstruction algorithm, and when the parameter configuration cue has a second meaning differing from the first meaning, effecting the configuration setting of the reconstruction algorithm using information on a coding algorithm with which the transmission channel data have been decoded from a coded version thereof, so that the configuration setting is identical to a configuration setting of the coding algorithm or depends on a configuration setting of the coding algorithm.

According to another embodiment, a device for generating a parameter data output which, together with transmission channel data including M transmission channels, represent N original channels, wherein M is less than N and is equal to or larger than 1, may have: multi-channel parameter means for providing the parameter data; signaling means for determining a parameter configuration cue, wherein the parameter configuration cue has a first meaning when configuration information contained in the parameter data output is to be used for a multi-channel reconstruction means, and wherein the parameter configuration cue has a second meaning when configuration data are to be used for a multi-channel reconstruction which are based on a coding algorithm to be used for coding or decoding the M transmission channels; and configuration data writing means for outputting the configuration information to obtain the parameter data output.

According to another embodiment, a method for generating a parameter data output which, together with transmission channel data including M transmission channels, represent N original channels, wherein M is less than N and is equal to or larger than 1, may have the steps of: providing the parameter data; determining a parameter configuration cue, wherein the parameter configuration cue has a first meaning when configuration information contained in the parameter data output is to be used for a multi-channel reconstruction algorithm, and wherein the parameter configuration cue has a second meaning when configuration data are to be used for a multi-channel reconstruction which are based on a coding algorithm to be used for coding or decoding the M transmission channels; and outputting the configuration information to obtain the parameter data output.

According to another embodiment, a device for generating a parameter data output which, together with transmission channel data including M transmission channels, represent N original channels, wherein M is less than N and is equal to or larger than 1, using input data, wherein the input data has a parameter configuration cue which has a first meaning that configuration information for a multi-channel reconstruction means is contained in the input data, or has a second meaning that the multi-channel reconstruction means is to use configuration information depending on a coding algorithm with which the transmission channel data have been decoded from a coded version thereof, may have: writing means for writing configuration data, wherein the writing means is designed to read the input data to interpret the parameter configuration cue, and when the parameter configuration cue has the second meaning, retrieve and output as the configuration data information on a coding algorithm with which the transmission channel data have been decoded from a coded version thereof.

According to another embodiment, a method for generating a parameter data output which, together with transmission channel data including M transmission channels, represent N original channels, wherein M is less than N and is equal to or larger than 1, using input data, wherein the input data has a parameter configuration cue which has a first meaning that configuration information for a multi-channel reconstruction means is contained in the input data, or has a second meaning that the multi-channel reconstruction means is to use configuration information depending on a coding algorithm with which the transmission channel data have been decoded from a coded version thereof, may have the steps of: reading the input data to interpret the parameter configuration cue, and when the parameter configuration cue has the second meaning, retrieving information on a coding algorithm with which the transmission channel data have been decoded from a coded version thereof, and outputting the retrieved configuration data.

According to another embodiment, a computer program may have a program code for performing one of the above-mentioned methods, when the computer program runs on a computer.

The present invention is based on the finding that efficiency on the one hand and flexibility on the other hand may be achieved by having the data stream, which can include transmission channel data and parameter data, contain a parameter configuration cue that has been inserted on the encoder side and is evaluated on the decoder side. This cue indicates whether a multi-channel reconstruction means is configured from the input data, i.e. from the data transmitted from the encoder to the decoder, or whether a multi-channel reconstruction means is configured by a cue to a coding algorithm with which coded transmission channel data have been decoded. The multi-channel reconstruction means has a configuration setting identical to a configuration setting of the audio decoder for decoding the coded transmission channel data or at least dependent on this setting.

If a decoder detects the first situation, i.e. the parameter configuration cue has a first meaning, the decoder will look for further configuration information in the received input data, to properly configure the multi-channel reconstruction means, to use the information then to effect a configuration setting of the multi-channel reconstruction means. Such a configuration setting could be, for example, block length, advance, sampling frequency, filter bank control data, so-called granule information (how many BCC blocks there are in a frame), channel configurations (e.g. a 5.1. output is generated whenever there is "mp3"), information on which parameter data are obligatory in a scaled case (e.g. ICLD) and which are not (ICTD), etc.

If, however, the decoder determines that the parameter configuration cue has a second meaning different from the first meaning, the multi-channel reconstruction means will choose the configuration setting in the multi-channel reconstruction means depending on information about the audio coding algorithm on which the coding/decoding of the transmission channel data, i.e. the downmix channels, is based.

In contrast to the separate concept of the parameter data on the one hand and the compressed downmix data on the other hand, the inventive device for generating a multi-channel audio signal commits a "theft", so to speak, for the configuration of the multi-channel reconstruction means, in the actually completely separate and self-sufficient audio data and/or in an upstream audio decoder operating self-sufficiently, to configure itself.

The inventive concept is particularly powerful in a preferred embodiment of the present invention when different audio coding algorithms are considered. In this case, a large amount of explicit signaling information would have to be transmitted for achieving a synchronous operation, i.e. an operation in which the multi-channel reconstruction means operates synchronously with the audio decoder, namely the corresponding advance lengths, etc. for each different coding algorithm, so that the actually independent multi-channel reconstruction algorithm runs synchronously with the audio decoding algorithm.

According to the invention, the parameter configuration cue, for which a single bit is sufficient, signals to a decoder that, for the purpose of its configuration, it is to look which audio encoder it is downstream to. Following this, the decoder will receive information on which audio encoder is currently upstream to a number of different audio encoders. When it has received this information, it will preferably enter a configuration table deposited in the multi-channel decoder with this audio coding algorithm identification to there retrieve the configuration information predefined for each of the possible audio coding algorithms to effect at least one configuration setting of the multi-channel reconstruction means. This achieves a significant data rate saving as compared to the case in which the configuration is explicitly signaled in the data stream, in which there is thus no consideration between the multi-channel reconstruction means and the audio decoder, and in which there is no inventive "theft" of audio decoder data by the multi-channel reconstruction means either.

On the other hand, the inventive concept still provides the high flexibility inherent to the explicit signaling of configuration information, because, due to the parameter configuration cue, for which a single bit in the data stream is sufficient, there is the possibility to actually transmit all configuration information in the data stream, if needed, or—as a mixed form—to transmit at least part of the parameter configuration information in the data stream and to take another part of necessary information from a set of laid down information.

In a preferred embodiment of the present invention, the data transmitted from the encoder to the decoder further include a continuation cue signaling to a decoder whether it should change configuration settings at all in comparison to already existing or previously signaled configuration settings, or whether it should continue as before, or whether, as a reaction to a certain setting of the continuation cue, the parameter configuration cue is read in to determine whether there should be an alignment of the multi-channel reconstruction means with respect to the audio decoder, or whether at least partially explicit information regarding the configuration are contained in the transmission data.

BRIEF DESCRIPTION OF THE DRAWINGS

Preferred embodiments of the present invention will be explained in more detail in the following with respect to the accompanying drawings, in which:

FIG. 4*c* is a preferred embodiment of the device for generating a multi-channel audio signal in syntax form;

DETAILED DESCRIPTION

Figure 1:
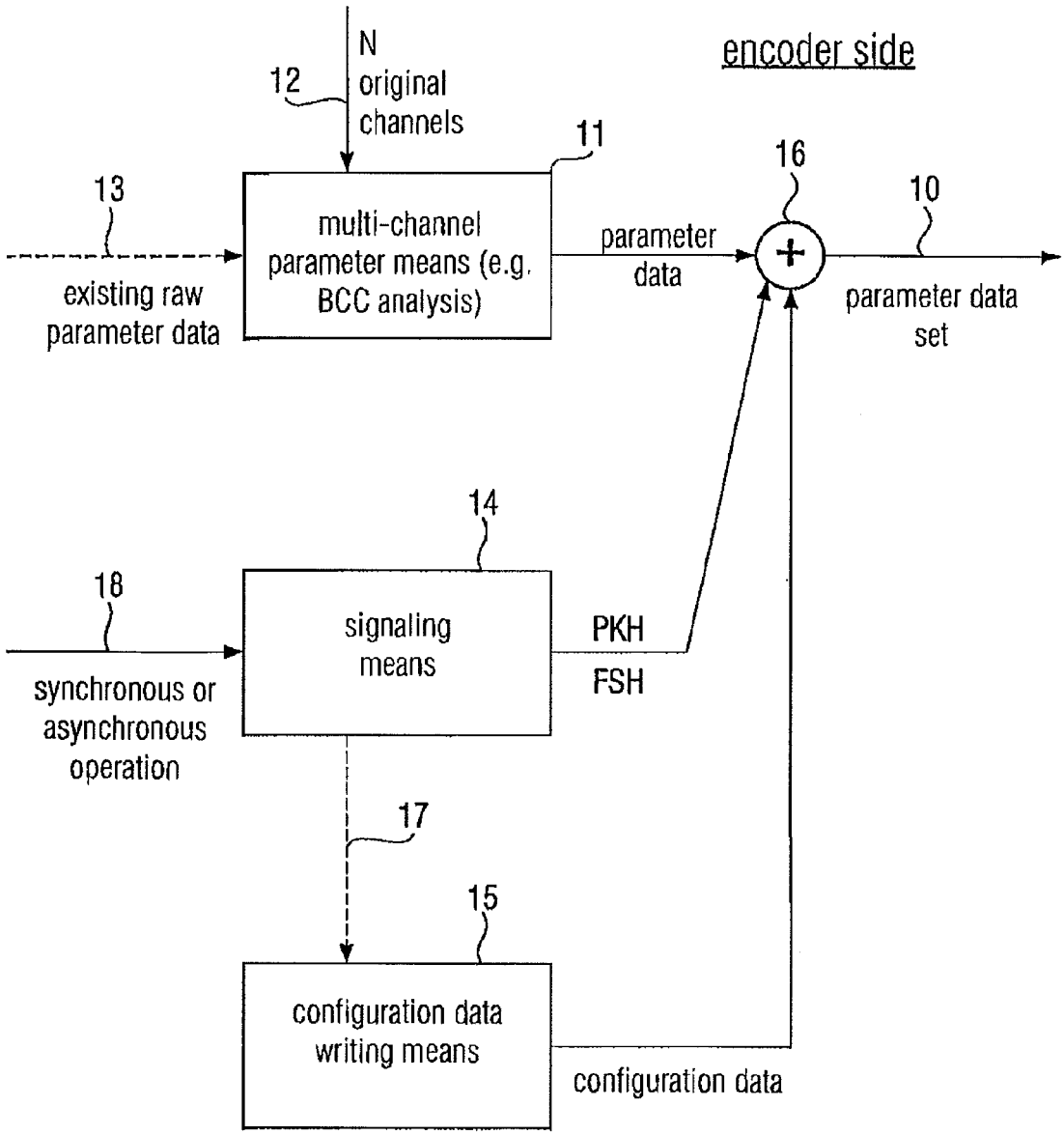
FIG. 1 is a block circuit diagram of an inventive device for generating a parameter data set usable on the encoder side.

FIG. 1 shows a block circuit diagram of an inventive device for generating a parameter data set, wherein the parameter data set may be output at an output 10 of the device shown in FIG. 1. The parameter data set contains parameter data which, together with transmission channel data not illustrated in FIG. 1, but which will be discussed later, represent N original channels, wherein the transmission channel data will typically include M transmission channels, wherein the number M of transmission channels is smaller than the number N of original channels and is equal to or larger than 1.

The device shown in FIG. 1, which will be accommodated on the encoder side, includes multi-channel parameter means 11 designed to perform, for example, a BCC analysis or an intensity stereo analysis or the like. In this case, the multi-channel parameter means 11 will receive N original channels at an input 12. Alternatively, however, the multi-channel parameter means 11 may also be designed as transcoder means to generate the parameter data at the output of means 11 using existing raw parameter data fed into a raw parameter input 13. If the parameter data are simple BCC data as they are provided by any BCC analysis means, the processing of the multi-channel parameter means 11 will simply consist in a copying function of the data from the input 13 into an output of means 11. However, the multi-channel parameter means 11 may also be designed to change the syntax of the raw parameter data stream to add, for example, signaling data or to write parameter sets that may be decoded or skipped at least partially independent of each other from the existing raw parameter data.

The device shown in FIG. 1 further includes signaling means 14 for determining and associating a parameter configuration cue PKH with the parameter data at the output of means 11. In particular, the signaling means is designed to determine the parameter configuration cue such that it has a first meaning when configuration information contained in the parameter data set are to be used for a multi-channel reconstruction. Alternatively, the signaling means 14 will determine the parameter configuration cue such that it has a second meaning when configuration data that are based on a coding algorithm that is to be used and/or has been used for coding the transmission channel data are to be used for a multi-channel reconstruction.

Finally, the inventive device of FIG. 1 includes configuration data writing means 15 designed to associate configuration information with the parameter data and the parameter configuration cue to finally obtain the parameter data set at output 10. The parameter data set 10 thus includes the parameter data from the multi-channel parameter means 11, the parameter configuration cue PKH from the signaling means 14 and, if applicable, configuration data from the configuration data writing means 15. In the parameter data set, these elements of the data set are arranged according to a determined syntax and are typically time multiplexed, as symbolically represented by an element generally referred to as combination means 16 in FIG. 1.

In a preferred embodiment of the present invention, the signaling means 14 is coupled to the configuration data writing means 15 via a control line 17 to activate the configuration data writing means 15 only when the parameter configuration cue has the first meaning, i.e. when, in a multi-channel reconstruction, no configuration information present in the decoder will be accessed in any way, but when there is explicit signaling, i.e. when further configuration information is present in the parameter data set. In the other case, in which the parameter configuration cue has the second meaning, the configuration data writing means 15 is not activated to introduce data in the parameter data set at the output 10, because such data would not be read by a decoder and/or would not be required by the decoder, as will be discussed later on. In the case of a mixed solution, instead of signaling everything in the data stream, only a part of the configuration is signaled, while the rest is taken, for example, from the configuration table in the decoder.

The signaling means 14 includes a control input 18, via which the signaling means 14 is informed of whether the parameter configuration cue is to have the first or the second meaning. As will be discussed with respect to FIGS. 4*a* and 4*b*, in the so-called "synchronous" operation, it is preferred to choose the parameter configuration cue so that it has the second meaning to obtain information on the coding algorithm in such a mode on the decoder side and to make configuration settings in the multi-channel reconstruction means on the decoder side depending thereon. In the asynchronous operation, however, the control input 18 will drive the signaling means such that it determines the first meaning for the parameter configuration cue, which will be interpreted by a decoder such that there is configuration information in the data themselves, and the audio coding algorithm on which the transmission channel data are based will not be used.

It is to be noted that the parameter data set and/or the parameter data output do not have to be in a rigid form with respect to each other. Thus, the configuration cue, the configuration data and the parameter data do not necessarily have to be transmitted together in a stream or packet, but may also be provided to the decoder separately from each other.

Figure 4A:
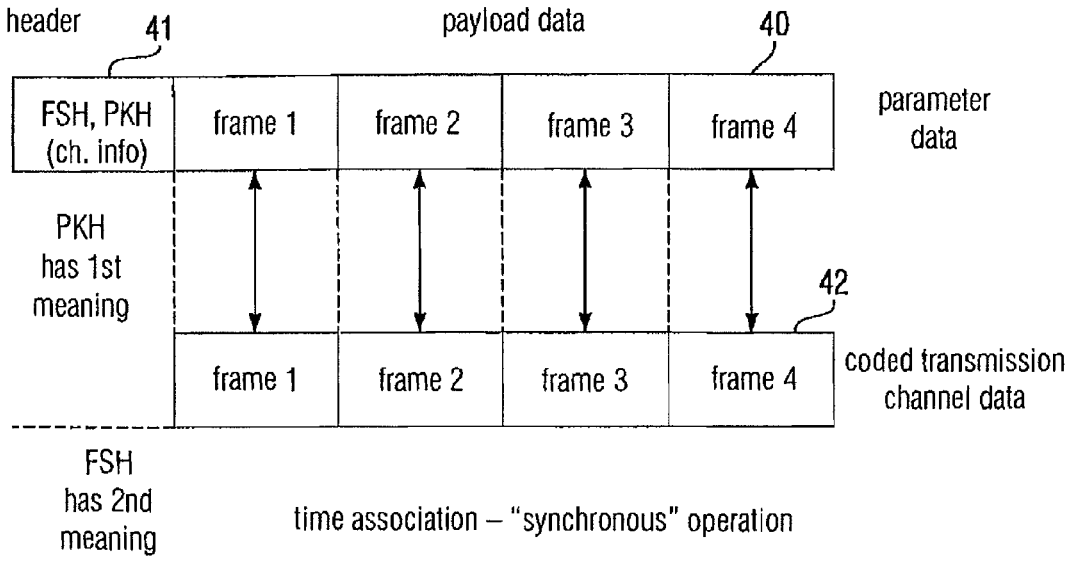
FIG. 4*a* is a schematic representation of the data streams for a synchronous operation between audio decoder and multi-channel reconstruction means.

The following discussion will present the so-called "synchronous" operation with respect to FIG. 4*a*. For the purpose of illustration, FIG. 4*a* illustrates the parameter data as a sequence of frames 40, wherein the sequence of frames 40 is preceded by a header 41 in which there is the parameter configuration cue generated by the signaling means 14, and in which, if applicable, there is further configuration information generated by the configuration data writing means 15. The parameter data at the output of means 11 are accommodated in the frames 1, 2, 3, 4, which is the reason why they are also called payload data in FIG. 4*a*.

The continuation cue FSH, which is mentioned both in FIG. 1 at the output of the signaling means 14 and is further also mentioned for the header 41 in FIG. 4*a*, causes a decoder to maintain, i.e. continue, a configuration setting previously communicated to the same, when it has a determined meaning, while, when the continuation cue FSH has another meaning, there is a decision on the basis of the parameter configuration cue whether configuration settings will be effected in the multi-channel reconstruction means based on configuration information in the data stream or based on configuration data retrieved by a cue to the audio coding algorithm on the decoder side.

FIG. 4*a* further represents a sequence 42 of blocks of coded transmission data in time association, which also have four frames, frame 1, frame 2, frame 3, frame 4. The time association of the parameter data with the coded transmission channel data is illustrated by vertical arrows in FIG. 4*a*. Thus, a block of coded transmission channel data will always relate to a block of input data and/or, when overlapping windows are used, at least the advance how much data in a block are newly processed as compared to the previous block will be laid down and, in synchronous operation, will be synchronous with the block length and/or the advance at which the parameter data are obtained. This ensures that the connection between reconstruction parameters on the one hand and transmission channel data on the other hand is not lost.

Figure 6:
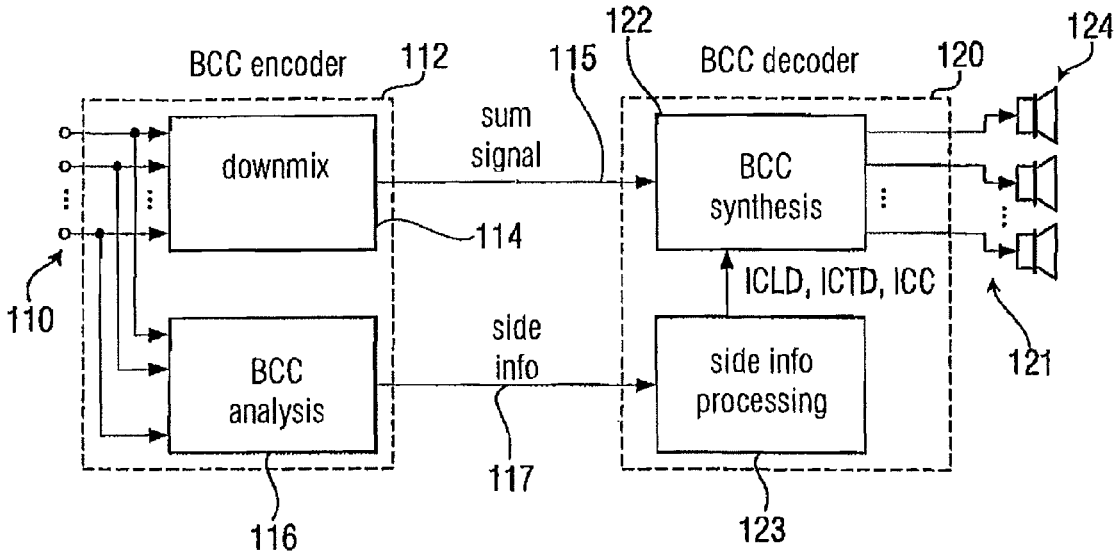
FIG. 6 is a schematic block diagram of a BCC encoder/BCC decoder path.
Figure 7:
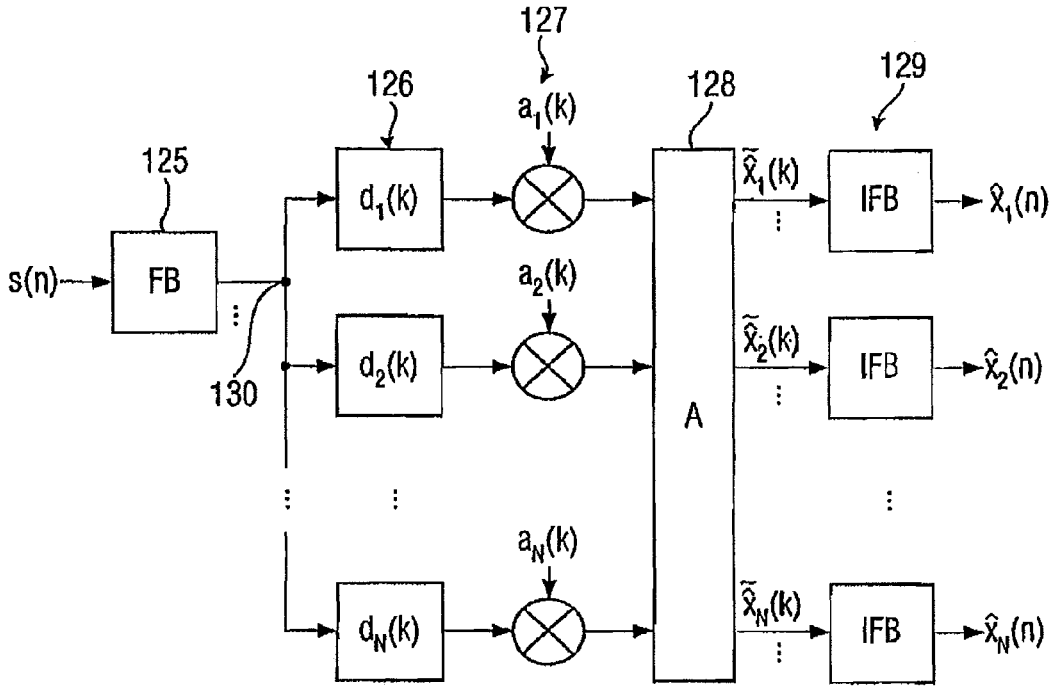
FIG. 7 is a block circuit diagram of the BCC synthesis block of FIG. 6.
Figure 8:
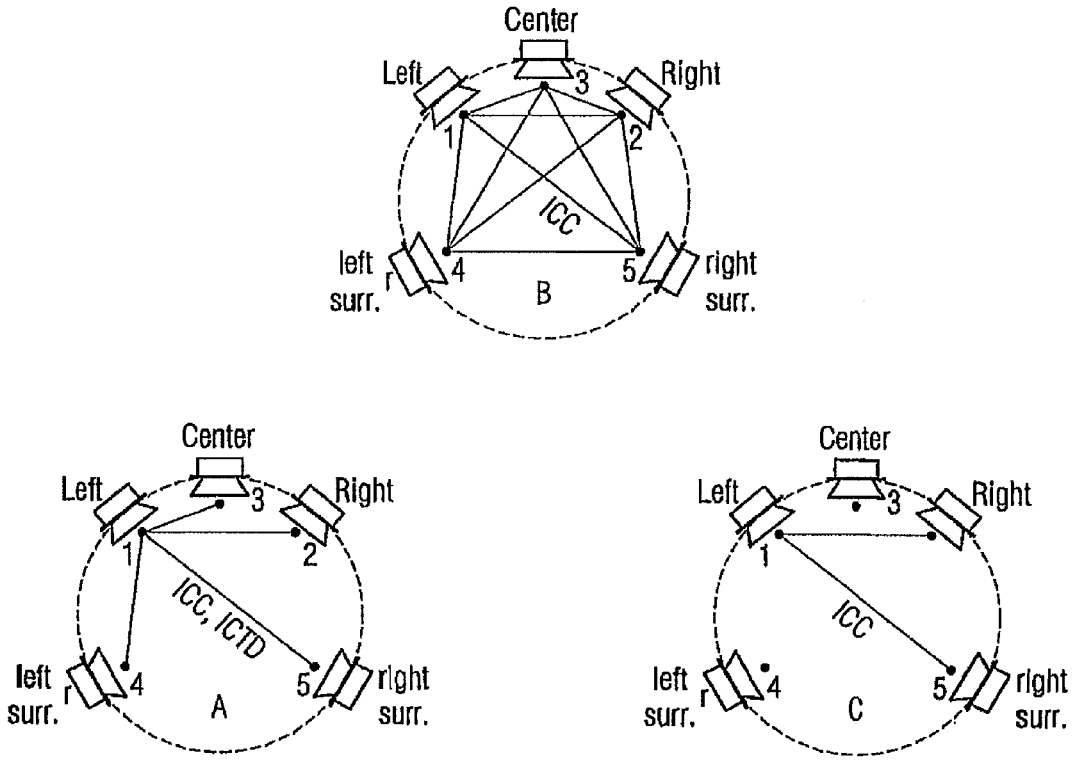
FIGS. 8A to 8C are a representation of typical scenarios for the calculation of the parameter sets ICLD, ICTD and ICC.

This will be explained by means of a short example. Assuming a 5-channel input signal, this 5-channel input signal will have five different audio channels including time samples from a time x to a time y, respectively. In the downmix stage 114 of FIG. 6, at least one transmission channel is then generated which will be synchronous with the multi-channel input data. A portion of the transmission channel data from time x to time y will thus correspond to a portion of the respective multi-channel input data from time x to time y. Furthermore, the BCC analysis means 116 of FIG. 6 generates, for example, parameter data, again exactly for the time section of the transmission channel data from time x to time y, so that, on the decoder side, there may again be generated respective output channel data from time x to time y from the transmission channel data from time x to time y and the parameter data from time x to time y.

A synchronous operation is automatically achieved when the framing with which the parameter data are generated and written is equal to the framing with which the audio encoder operates for compressing the one or more transmission channels. If thus the frames of both the parameter data and the coded transmission channel data (40 and 42 in FIG. 4*a*) always relate to the same time portion, a multi-channel reconstruction device may easily always process data corresponding to an audio frame and process a parameter frame at the same time.

In synchronous operation, the frame length of the audio encoder used for the transmission of the downmix data is thus equal to the frame length used by the parametric multi-channel scheme. Similarly, there is of course also the possibility that there is an integer relationship between the frame lengths and the parameter data and the coded transmission channel data. In this case, even the side information for parametric multi-channel coding may be multiplexed into the coded bit stream of the audio downmix signal so that a single bit stream may be generated. In the case of "retrofitting" already existing stereo data, there would still be two different data streams. However, there would be a relationship of 1:1 and/or m:1 or m:n between the two sequences of frames. The framing rasters would never shift with respect to each other. Thus, there is an unambiguous association between the audio data frames and the corresponding parametric side information data frames. This mode may be favorable for various applications.

According to the invention, the parameter configuration cue would have the first meaning in such a case. This means that there would be no or only part of the configuration information in the header 41, because the multi-channel reconstruction means provides itself with information on the underlying audio encoder and, dependent thereon, chooses its configuration setting, i.e. for example the number of time samples for the advance or the block length, etc.

Figure 4B:
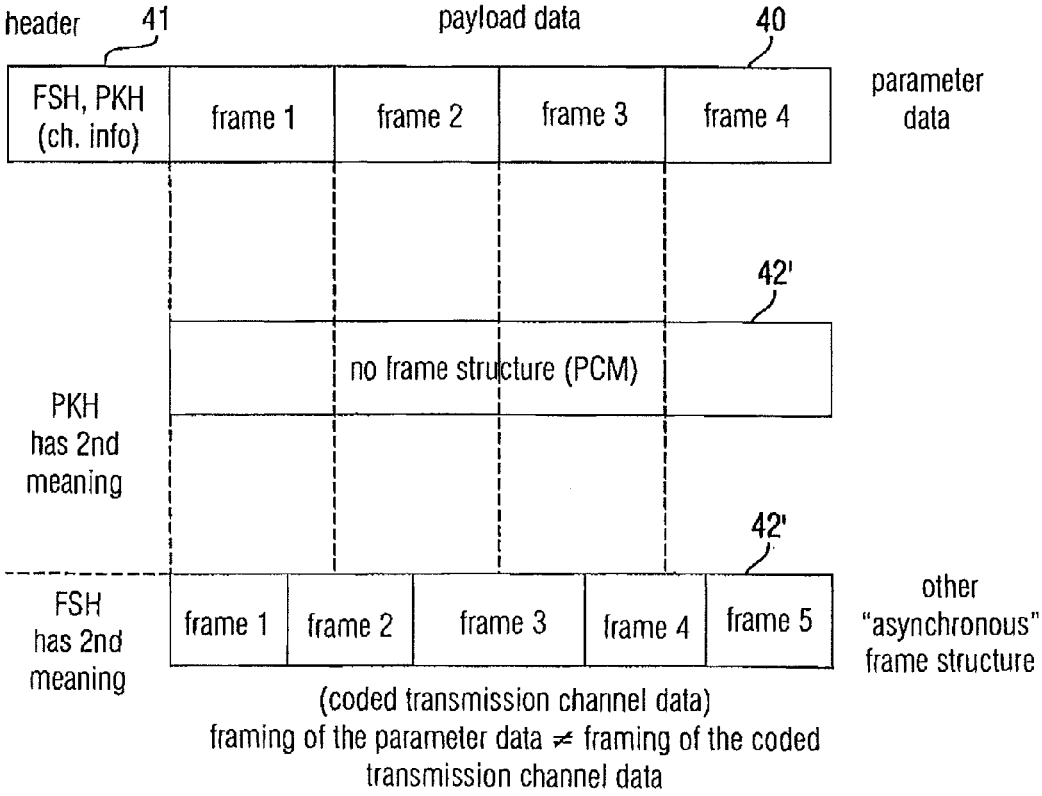
FIG. 4*b* is a schematic representation of the data streams for an asynchronous operation between audio decoder and multi-channel reconstruction means.
Figure 5:
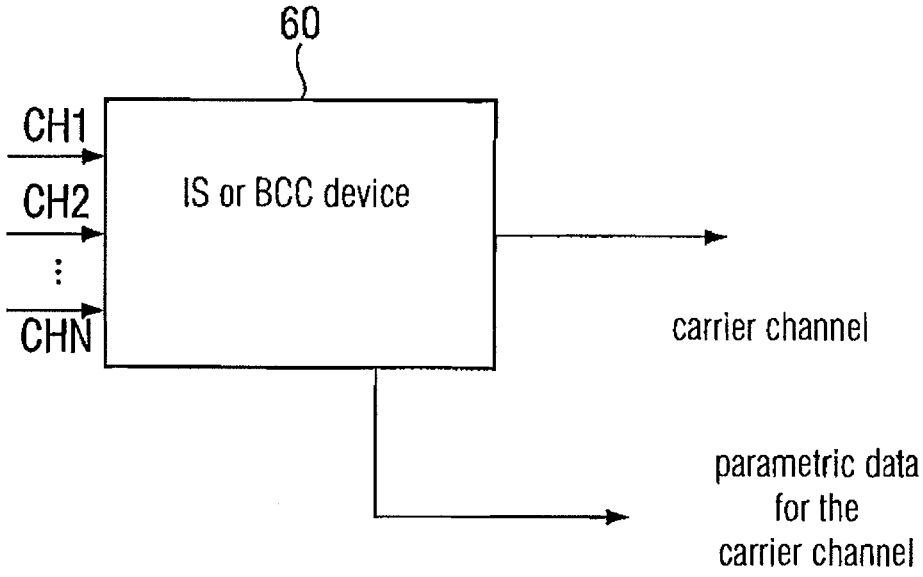
FIG. 5 is a general representation of a multi-channel encoder.

In contrast, FIG. 4*b* shows an asynchronous operation. An asynchronous operation exists when the transmission channel data 42' do not, for example, have a frame structure, but only occur as a stream of PCM samples. Alternatively, such an asynchronous situation would also arise when the audio encoder has an irregular frame structure or simply a frame structure with a frame length and/or a frame raster differing from the frame raster of the parameter data 40. Here, the parametric multi-channel coding scheme and the audio coding/decoding means are thus considered as isolated and separate processing stages which do not depend on each other. This is particularly advantageous in the case of so-called tandem coding scenarios in which there are several successive stages of coding/decoding. If the parameter data were fixedly coupled to the compressed audio data, a multi-channel synthesis and a subsequent multi-channel analysis would have to be done simultaneously in each coding/decoding. As these operations are lossy, the losses would gradually accumulate, which would result in an increasing deterioration of the multi-channel impression.

In such a tandem chain, the setting of the parameter configuration cue to the second meaning and the writing of configuration information into the data stream allow a configuration setting of the multi-channel reconstruction means in the decoder independently of the underlying audio encoder. Downmix data may thus be decoded/coded in any way without always having to perform a multi-channel synthesis or multi-channel analysis at the same time. The introduction of configuration information into the data stream and preferably into the parameter data stream according to the parameter data syntax allows, so to speak, to lay down an absolute association of the parameter data with time samples of the decoded transmission channel data, i.e. an association that is self-sufficient and is not given relative to an encoder frame processing rule, as in synchronous operation.

In asynchronous operation, the deterioration of the multi-channel sound characteristics is thus prevented, because there is not always performed a multi-channel analysis/synthesis. The frame size for the parametric multi-channel coding/decoding thus does not necessarily have to be connected to the frame size of the audio encoder.

The device of FIG. 1 can be implemented both as encoder and as so-called "forward transcoder". In the first case, the multi-channel parameter means calculates the parameter data itself. In the second case, it receives the parameter data already in a determined form and provides the inventive parameter data output with the parameter configuration cue and associated configuration data. The forward transcoder thus generates the inventive parameter data output from any data output.

The reversal of this measure is done by a so-called "backward transcoder" which, from the inventive parameter data output, generates some output in which the parameter configuration cue is no longer contained, in which, however, the configuration data are also completely contained, so that no use of an audio coding algorithm is necessary in the multi-channel reconstruction for the configuration.

According to the invention, the backward transcoder is designed as device for generating a parameter data output which, together with transmission channel data including M transmission channels, represent N original channels, wherein M is smaller than N and equal to or larger than 1, using input data, wherein the input data comprise a parameter configuration cue (41) that has a first meaning that configuration information for a multi-channel reconstruction means are contained in the input data, or has a second meaning that the multi-channel reconstruction means is to use configuration information depending on a coding algorithm (23) with which the transmission channel data have been decoded from a coded version thereof. It contains a writing means for writing configuration data, wherein the writing means is designed to first read the input data to interpret (30) the parameter configuration cue, and to retrieve information about a coding algorithm (23) with which the transmission channel data have been decoded from a coded version thereof and to output it as the configuration data, when the parameter configuration cue has the second meaning.

In the following, there will be described a block circuit diagram of a device for generating a multi-channel audio signal according to a preferred embodiment of the present invention with respect to FIG. 2. For generating the multi-channel audio signal, input data are used that include transmission channel data representing the M transmission channels and that further include parameter data 21 to obtain K output channels. The M transmission channels and the parameter data together represent N original channels, wherein M is smaller than N and is equal to or larger than 1, and wherein K is larger than M. Furthermore, the input data include a parameter configuration cue PKH, as already discussed, while the transmission channel data 20 are a decoded version of transmission channel data 22 coded according to a coding algorithm. In the embodiment shown in FIG. 2, the decoding algorithm is realized by an audio decoder 23 having a coding algorithm operating, for example, according to the MP3 concept or according to MPEG-2 (AAC) or according to any other coding concept.

Figure 2:
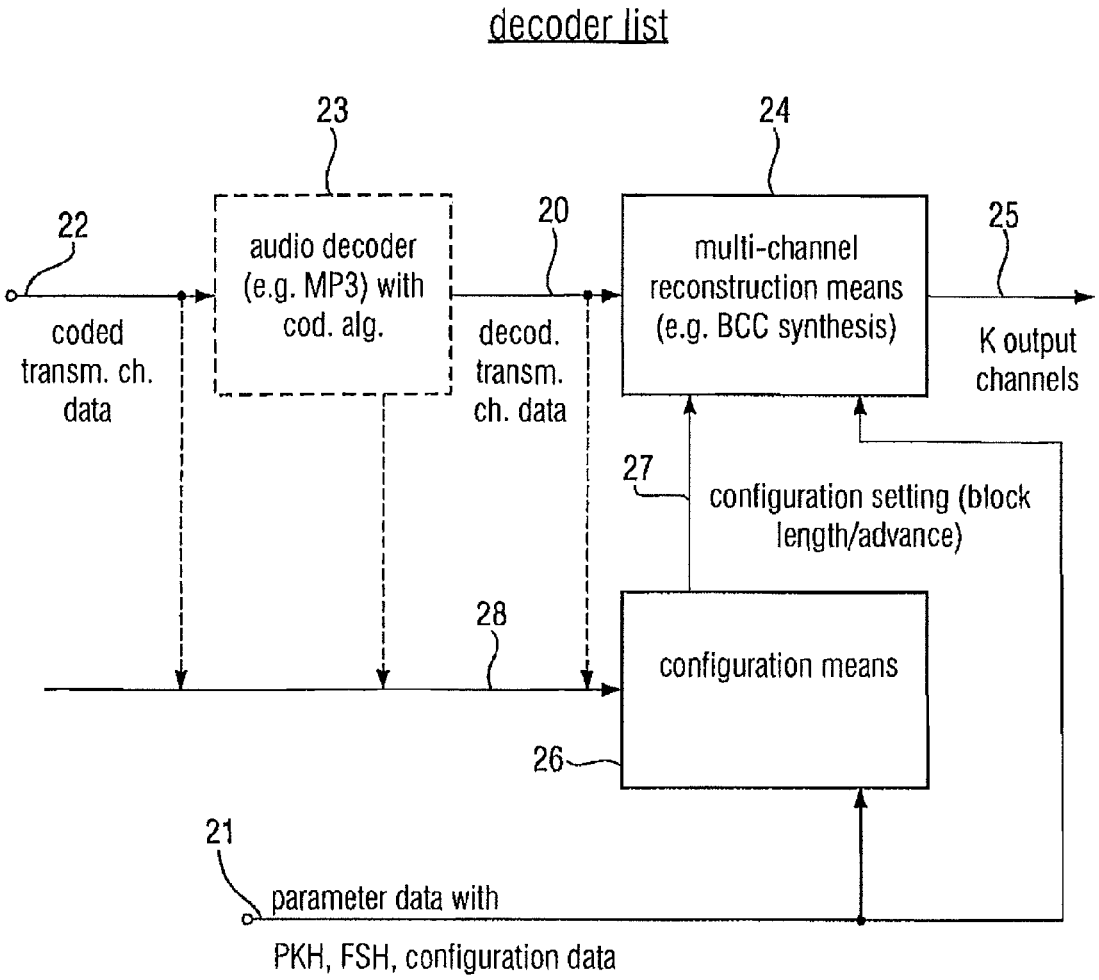
FIG. 2 is a block circuit diagram of a device for generating a multi-channel audio signal used on the decoder side.

The device to be used on the decoder side shown in FIG. 2 includes a multi-channel reconstruction means 24 designed to generate the K output channels at an output 25 from the transmission channel data 20 and the parameter data 21.

Furthermore, the inventive device shown in FIG. 2 includes configuration means 26 designed to configure the multi-channel reconstruction means 24 by signaling a configuration setting via a signaling line 27. The configuration means 26 receives the input data and preferably the parameter data 21 to read and correspondingly process the parameter configuration cue, the continuation cue FSH and possibly present configuration data. Furthermore, the configuration means includes a coding algorithm signaling input 28 to obtain information about the audio coding algorithm on which the decoded transmission channel data are based, i.e. the coding algorithm executed by the audio encoder 23. The information may be obtained in different ways, for example from an observation of the decoded transmission channel data, if it can be seen from them with which coding algorithm they have been coded/decoded. Alternatively, the audio decoder 23 may itself communicate its identity to the configuration means 26. Still alternatively, the configuration means 26 may also parse the coded transmission channel data 22 to determine a cue from the coded transmission channel data according to which coding algorithm coding has taken place. Such a "coding algorithm signature" will typically be contained in each output data stream of an encoder.

Figure 3:
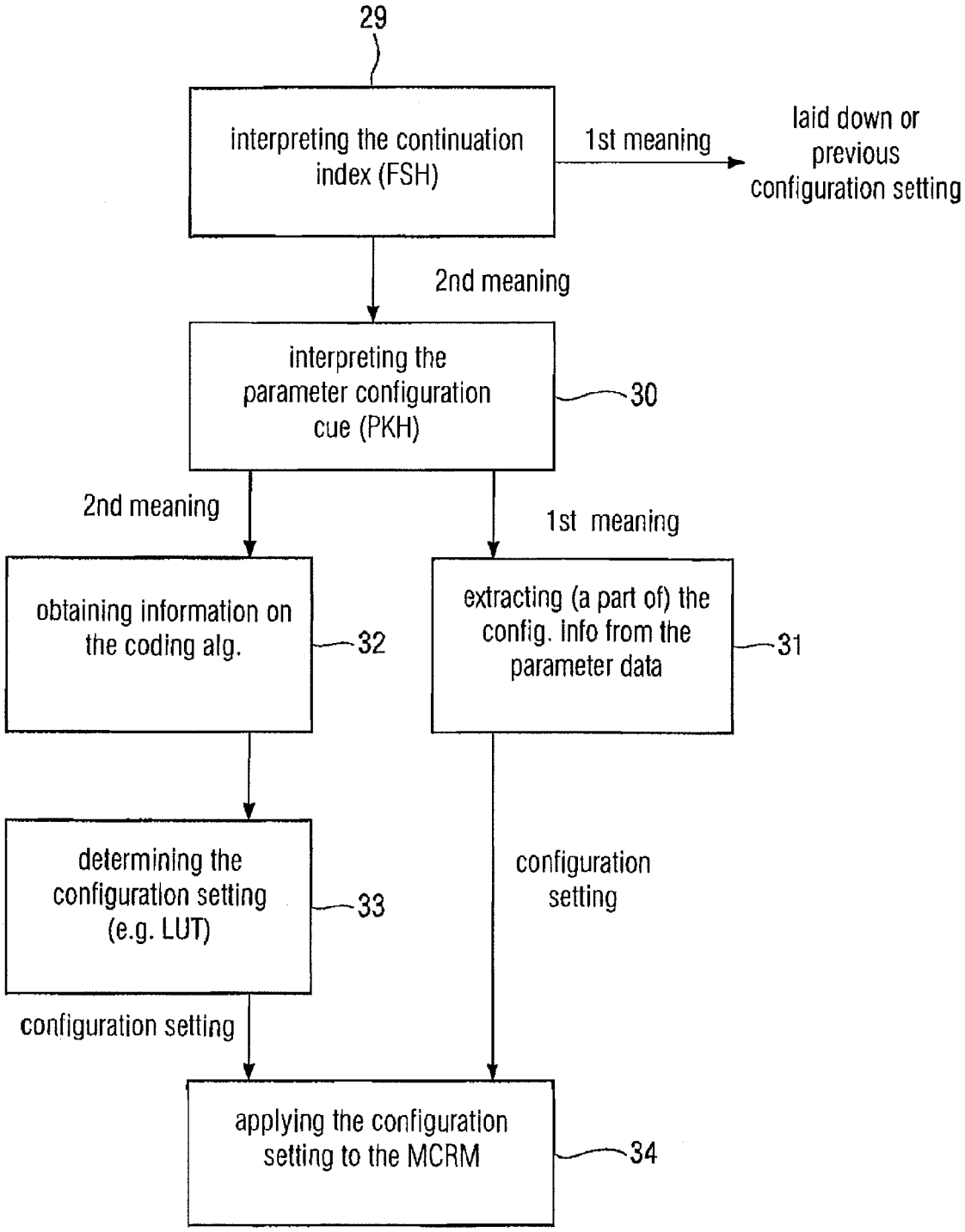
FIG. 3 is a principle flow chart of the operation of the configuration means of FIG. 2 in a preferred embodiment of the present invention.

In the following, a preferred implementation of the configuration means will be described based on a block diagram with respect to FIG. 3*a*. The configuration means 26 is designed to read the parameter configuration cue PKH from the input data and to interpret it, as illustrated in block 30. If the parameter configuration cue has a first meaning, the configuration means will continue to read in the parameter data stream to extract configuration information (or at least part of the configuration information) in the parameter data stream, as illustrated in block 31. If, however, step 30 determines that the parameter configuration cue PKH has the second meaning, the configuration means will obtain information on a coding algorithm on which the decoded transmission channel data are based, in step 32.

If there are several basically possible coding algorithms for which the inventive device for generating the multi-channel signal is designed, step 32 is followed by a subsequent step 33 in which the multi-channel reconstruction means determines (33) a configuration setting based on information existing on the decoder side. This may be done, for example, in the form of a look-up table (LUT). If, at the end of step 32, an audio encoder identification cue is obtained, a look-up table is entered in step 33 using the audio encoder identification cue, wherein the audio encoder identification cue is used as index. Associated in the index there are found various configuration settings, such as block length, sampling rate, advance, etc. associated with such an audio encoder.

A configuration setting is then applied to the multi-channel reconstruction means in step 34. If, however, the first meaning of the parameter configuration cue is chosen in step 30, the same configuration setting is effected based on configuration information contained in the parameter data stream, as represented by the connecting arrow between block 31 and block 34 in FIG. 3.

The inventive scheme is flexible in that it supports both explicit and implicit configuration information signaling methods. This is what the parameter configuration cue PKH serves for, which is preferably inserted as flag and, in the best case, requires only a single bit to indicate the signaling of the configuration information per se. The parametric multi-channel decoder may subsequently evaluate this flag. If the availability of explicitly available configuration information is signaled with this flag, this configuration information is used. If, on the other hand, implicit signaling is indicated by the flag, the decoder will use the information on the used audio or voice coding method and apply configuration information based on the signaled coding method. For this purpose, the parametric multi-channel decoder and/or the multi-channel reconstruction means preferably has a look-up table containing the standard configuration information for a determined number of audio or voice encoders. There are, however, also other possibilities than a look-up table which may, for example, include hard-wired solutions, etc. Generally, the decoder is capable of providing the configuration information with predetermined information present in itself depending on the actually present encoder identification information.

This concept is particularly advantageous in that a complete configuration of the parameter scheme may be achieved with a minimum of additional effort, wherein, in the extreme case, a single bit will be sufficient, which forms a contrast to the situation that all configuration information would have to be written explicitly into the data stream itself with a considerably higher effort regarding bits.

According to the invention, the signaling may be switched back and forth. This allows simple multi-channel data handling, even if the representation of the transmission channel data changes, for example when the transmission channel data are decoded and later coded again, i.e. when there is a tandem coding situation.

The inventive concept thus allows the saving of signaling bits in the case of synchronous operation on the one hand and switching to asynchronous operation on the other hand, if necessary, i.e. an efficient bit-saving implementation and, on the other hand, flexible handling, which will be of particular interest in connection with the "supplementation" of existing stereo data to a multi-channel representation.

In the following, there will be given an exemplary implementation of the inventive device for generating a multi-channel audio signal with the example of a syntax pseudo code, with respect to FIG. 4*c*. First, the value of the variable "useSameBccConfig" is read in. Here, the variable serves as continuation cue. So, there is only a continuation to interpret the parameter configuration cue when this variable, i.e. the continuation cue, has a value equal to, for example, 1. If, however, the continuation cue is unequal to 1, i.e. it has the other meaning, a previously transmitted configuration is used. If there is no configuration in the multi-channel reconstruction means yet, it has to wait until it obtains the very first configuration information and/or configuration setting.

The following will examine the parameter configuration cue. The variable "codecToBccConfigAlignment" serves as parameter configuration cue PKH. If this variable is equal to 1, i.e. if it has the second meaning, the decoder will not use any further configuration information, but will determine the configuration information based on the encoder identification, such as MP3, CoderX or CoderY, as can be seen from the lines starting with "case" in FIG. 4*c*. It is to be noted that, by way of example, the syntax shown in FIG. 4*c* only supports MP3, CoderX and CoderY. However, any other coding names/identifications may be added.

When, for example, MP3 has been determined as encoder information, the variable bccConfigID is set to, for example, MP3_V1, which is the configuration for an underlying MP3 encoder with the syntax version V1. Subsequently, the decoder is configured with a determined parameter set based on this BCC configuration identification. Thus, for example, a block length of 576 samples is activated as configuration setting. Thus, a framing having this block length is signaled. Alternative/additional configuration settings may be the sampling rate, etc. If, however, the parameter configuration cue (codecToBccConfigAlignment) has the first meaning, i.e. for example the value 0, the decoder will explicitly receive configuration information from the data stream, i.e. it will receive a distinct bccConfigID from the data stream, i.e. from the input data. The following procedure is then the same as just described. In this case, however, an identification of the decoder for decoding the coded transmission channel data is not used for configuration purposes of the multi-channel reconstruction means.

Thus, the bccConfigID may be used for the purpose of decoding the transmission channel data in the case of an MP3 audio decoder for configuring a multi-channel reconstruction means. On the other hand, there may also be any other configuration information bccConfigID in the data stream and may be evaluated, irrespective of whether or not the underlying audio encoder is an MP3 encoder. The same applies to other predefined configuration settings, such as CoderX and CoderY, and to a further free configuration in which the configuration information (bccConfigID) is set to individual. In preferred embodiments, there are further configuration information in the data stream which, in turn, signal to the decoder that it should use a mixture of already predefined configuration information present in the decoder and explicitly transmitted configuration information.

Unlike the above-described embodiments, the present invention may also be applied to other multi-channel signals which are no audio signals, such as parametrically coded video signals, etc.

Depending on the circumstances, the inventive method for generating and/or decoding may be implemented in hardware or in software. The implementation may be done on a digital storage medium, in particular a floppy disk or CD having control signals that may be read out electronically, which may cooperate with a programmable computer system so that the method is executed. In general, the invention thus also consists in a computer program product having a program code for performing the method stored on a machine-readable carrier, when the computer program product runs on a computer. In other words, the invention may thus be realized as a computer program having a program code for performing the method, when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A device for generating a multi-channel signal using input data which include transmission channel data representing M transmission channels and parameter data to obtain K output channels, wherein the M transmission channels and the parameter data together represent N original channels, wherein M is less than N and equal to or larger than 1, and wherein K is larger than M, wherein the input data comprise a parameter configuration cue, comprising:

a multi-channel reconstructor designed to generate the K output channels from the transmission channel data and the parameter data; and a configurator connected to the multi-channel reconstructor, wherein the configurator is adapted to configuring the multi-channel reconstructor, wherein the configurator is designed to read the input data to interpret the parameter configuration cue, when the parameter configuration cue has a first meaning, extract configuration information contained in the input data and effect a configuration setting of the multi-channel reconstructor, and when the parameter configuration cue has a second meaning differing from the first meaning, configure the multi-channel reconstructor using information on a coding algorithm with which the transmission channel data have been decoded from a coded version thereof so that the configuration setting of the multi-channel reconstructor is identical to a configuration setting of the coding algorithm or depends on a configuration setting of the coding algorithm, wherein the multi-channel reconstructor or the configurator comprises a hardware implementation.

2. The device according to claim 1, wherein the transmission channel data comprise a transmission channel data stream comprising a transmission channel data syntax, wherein the parameter data comprise a parameter data stream comprising a parameter data syntax, wherein the transmission channel data syntax differs from the parameter data syntax, and wherein the parameter configuration cue is inserted in the parameter data according to this syntax, wherein the configurator is designed to read the parameter data according to the parameter data syntax and to extract the parameter configuration cue.

3. The device according to claim 1, wherein the multi-channel reconstructor is designed to perform processing in blocks, wherein the transmission channel data are a sequence of samples, and wherein the configuration setting includes a block length or an advance number of samples which are newly processed by the multi-channel reconstructor per processing of a block.

4. The device according to claim 3, wherein the transmission channel data are time samples of the at least one transmission channel, and the multi-channel reconstructor comprises a filter bank to convert a block of time samples of the transmission channel data to a frequency domain representation.

5. The device according to claim 1, wherein the parameter data comprise a sequence of blocks of parameter values, wherein a block of parameter values is associated with a time portion of the at least one transmission channel, wherein the multi-channel reconstructor is designed so that the configuration setting causes the block of parameter values and the associated time portion of the at least one transmission channel to be used for generating the K output channels.

6. The device according to claim 1, wherein the coding algorithm is one of a plurality of various coding algorithms, and wherein the configurator comprises a look-up table which includes an index and a set of configuration information associated with the index for a coding algorithm, which respectively comprise the configuration setting for the coding algorithms, wherein the configurator is designed to determined the index for the look-up table from the information on the coding algorithm and to determine therefrom the configuration information for the multi-channel reconstructor.

7. The device according to claim 1, wherein the input data comprise configuration information for the multi-channel reconstructor in the case of a parameter configuration cue comprising the first meaning, and comprise only part of or no configuration information for the multi-channel reconstructor in the case of the parameter configuration cue comprising the second meaning.

8. The device according to claim 1, wherein the configurator is designed to extract only part of required configuration information from the input data when the parameter configuration cue has the second meaning, and to use a remaining part of configuration information from preset configuration information known to the multi-channel reconstructor.

9. The device according to claim 1, wherein the configurator is designed to obtain the information on the coding algorithm via a connecting line via which the configurator may be connected to a decoder which generates the transmission channel data from the coded transmission channel data, or to obtain the information on the coding algorithm by reading the transmission channel data or the coded transmission channel data, when the parameter configuration cue has the second meaning.

10. The device according to claim 1, wherein the input data further comprise a continuation cue, and wherein the configurator is designed to read and interpret the continuation cue to effect a fixedly set or previously signaled configuration setting of the multi-channel reconstructor in a case of the continuation cue comprising a first meaning, and to configure the multi-channel reconstructor on the basis of the parameter configuration cue only in the case of the continuation cue comprising a second meaning differing from the first meaning.

11. The device according to claim 10, wherein the continuation cue is associated with the parameter data according to a parameter data syntax and is a flag in the parameter data stream.

12. The device according to claim 1, wherein the parameter configuration cue is associated with the parameter data according to a parameter data syntax and is a flag in the parameter data stream.

13. The device according to claim 11, wherein the continuation cue or the parameter configuration cue each include a single bit.

14. A method for generating a multi-channel signal using input data which include transmission channel data representing M transmission channels and parameter data to obtain K output channels, wherein the M transmission channels and the parameter data together represent N original channels, wherein M is less than N and equal to or larger than 1, and wherein K is larger than M, wherein the input data comprise a parameter configuration cue, comprising:

reconstructing, by a multi-channel reconstructor, the K output channels from the transmission channel data and the parameter data according to a reconstruction algorithm;

configuring, by a configurator, the reconstruction algorithm by the following sub-steps:

reading the input data to interpret the parameter configuration cue;

when the parameter configuration cue has a first meaning, extracting configuration information contained in the input data and effecting a configuration setting of the reconstruction algorithm, and when the parameter configuration cue has a second meaning differing from the first meaning, effecting the configuration setting of the reconstruction algorithm using information on a coding algorithm with which the transmission channel data have been decoded from a coded version thereof, so that the configuration setting is identical to a configuration setting of the coding algorithm or depends on a configuration setting of the coding algorithm, wherein the multi-channel reconstructor or the configurator comprises a hardware implementation.

15. A non-transitory computer readable storage medium having stored thereon a computer program comprising a program code for performing the method for generating a multi-channel signal using input data which include transmission channel data representing M transmission channels and parameter data to obtain K output channels, wherein the M transmission channels and the parameter data together represent N original channels, wherein M is less than N and equal to or larger than 1, and wherein K is larger than M, wherein the input data comprise a parameter configuration cue, comprising:

reconstructing the K output channels from the transmission channel data and the parameter data according to a reconstruction algorithm;

configuring the reconstruction algorithm by the following sub-steps:

reading the input data to interpret the parameter configuration cue;

when the parameter configuration cue has a first meaning, extracting configuration information contained in the input data and effecting a configuration setting of the reconstruction algorithm, and when the parameter configuration cue has a second meaning differing from the first meaning, effecting the configuration setting of the reconstruction algorithm using information on a coding algorithm with which the transmission channel data have been decoded from a coded version thereof, so that the configuration setting is identical to a configuration setting of the coding algorithm or depends on a configuration setting of the coding algorithm, when the computer program runs on a computer.

* * * * *